US009062403B2

(12) United States Patent
Zaglio

(10) Patent No.: US 9,062,403 B2
(45) Date of Patent: Jun. 23, 2015

(54) MACHINE FOR CLEANING, WASHING, DRYING AND IRONING CLOTHES AND GARMENTS

(76) Inventor: Sergio Zaglio, Castiglione D/S (IT)

( * ) Notice: Subject to any disclaimer, the term of this patent is extended or adjusted under 35 U.S.C. 154(b) by 1146 days.

(21) Appl. No.: 12/740,001

(22) PCT Filed: Oct. 7, 2008

(86) PCT No.: PCT/IT2008/000637

§ 371 (c)(1),
(2), (4) Date: Apr. 27, 2010

(87) PCT Pub. No.: WO2009/057177

PCT Pub. Date: May 7, 2009

(65) Prior Publication Data

US 2010/0251779 A1 Oct. 7, 2010

(30) Foreign Application Priority Data

Oct. 31, 2007 (IT) ..... BS2007A0168

(51) Int. Cl.

| | |
|---|---|
| ***D06F 29/00*** | (2006.01) |
| ***D06F 17/04*** | (2006.01) |
| ***A47G 25/20*** | (2006.01) |
| ***D06F 18/00*** | (2006.01) |
| ***D06F 58/10*** | (2006.01) |

(52) U.S. Cl.

CPC ..... *D06F 17/04* (2013.01); *A47G 25/20* (2013.01); *D06F 18/00* (2013.01); *D06F 58/10* (2013.01)

(58) Field of Classification Search

CPC ..... D06F 17/04; D06F 18/00; D06F 58/10; D06F 73/02; D06F 73/00

USPC ..... 68/13 R, 5 R, 5 A, 5 B, 5 C, 5 E, 12.08, 68/12.12, 12.13, 12.15, 12.18, 12.23, 17 R, 68/18 R, 200, 222; 134/23, 24, 26, 30, 31, 134/32, 34, 36, 37, 22.15, 22.18, 22.12, 134/56 R, 58 R, 85, 88, 94.1, 95.1, 98.1, 134/99.1, 102.1, 103.1, 103.2, 105, 109, 134/144, 147, 167 R, 172, 198, 200; 34/364, 34/377, 402, 415, 416, 417, 423, 443, 445, 34/467, 492, 508, 509, 510, 516, 524, 576, 34/102, 130, 132, 145, 241, 218; 8/137, 8/142, 149.1, 149.2, 158

See application file for complete search history.

(56) References Cited

U.S. PATENT DOCUMENTS

| | | | | |
|---|---|---|---|---|
| 2,075,724 | A * | 3/1937 | Jacobs | 223/51 |
| 3,672,188 | A * | 6/1972 | Geschka et al. | 68/12.15 |
| 5,516,012 | A * | 5/1996 | Weigel | 223/51 |
| 2004/0112095 | A1 * | 6/2004 | Bolduan et al. | 68/5 C |
| 2006/0101867 | A1 * | 5/2006 | Kleker | 68/5 C |

FOREIGN PATENT DOCUMENTS

| | | |
|---|---|---|
| FR | 2 092 259 | 1/1971 |
| GB | WO 2006/134364 | 12/2006 |
| WO | WO 2004/091359 | 10/2004 |

* cited by examiner

*Primary Examiner* — Michael Barr
*Assistant Examiner* — Thomas Bucci
(74) *Attorney, Agent, or Firm* — McGlew and Tuttle, P.C.

(57) ABSTRACT

The present invention relates to a multifunction machine for laundries, which comprises a body or frame (11) defining a treatment chamber (12) hermetically closed and equipped with means (15) for hanging elements (14), such as bed linen, clothes and garments, to be treated; means for removing stains, a wash and rinse; means for drying; and means for ironing said elements while they are hanging and stretched out in said treatment chamber.

20 Claims, 4 Drawing Sheets

MACHINE FOR CLEANING, WASHING, DRYING AND IRONING CLOTHES AND GARMENTS

FIELD OF THE INVENTION

This invention concerns the machines for the laundry sector which is for cleaning and washing bed linen, cloths and clothes in general and for final drying and ironing services.

STATE OF THE TECHNIQUE

The most usually, at least, the washing machines for domestic use are provided exclusively for washing the bed linen, cloths and clothing (herein after simply defined as clothing).

These machines can be of various types and with different loading systems, but with them once the clothing, has been washed and possibly spin-dried to squeeze them, they must be unloaded and hung on the clothes horse to dry, before proceeding with final ironing using an iron.

Also well known are the so-called wash and dry machines where the clothing after being washed are dried with the help of hot air, but they still have to be collected and then ironed.

When however it is necessary to remove stains from some parts of an item of clothing, an operation usually carried out by hand and often solved by rubbing and consequently locally wearing the fabric, before it is put in the washing machine.

OBJECTS AND SUMMARY OF THE INVENTION

One object of this invention is on the one hand to provide a machine for use in the abovementioned field and devised to carry out numerous functions, such as to remove stains, wash, dry and iron in succession different types of clothing, without having to remove them from the machine and collect them between one operation and another and with the advantage that neither a clothes horse or an iron are necessary required.

Another object is to provide a multi-function machine able to remove stains also in loco before the washing process, let alone specific and selective washings of the dirtiest parts of the clothing, in particular if garments.

Yet another object of the invention is to propose a multi-function machine usable for efficient cleaning both with water and for dry cleaning, using correct solvents, and possibly the sterilisation of the cleaned clothing.

A further object of the invention is to propose a machine able to intensify the stain removal action thanks to the spraying of fluids under pressure, movable to the clothing to be treated, however with the advantages of not wearing out the material, of consuming less detergent or solvents and therefore of reducing the running costs.

A further object of the invention is to propose a to remove stains, to clean, dry and iron where it is possible to define and limit the treatment zones enabling at least to save on energy, treatment fluid and detergents.

An additional object is to propose a machine in which the washing takes place under such conditions that the clothing treated does not have to be left to soak with the advantage of not attacking and altering the colours of coloured clothing and discharging non polluted washing fluid with colouring agents.

An added object of the invention is to propose a stain remover—cleaner—ironer—dryer machine in the configuration of a module which can be coupled with other similar modules to define their capacity based on the amount of clothing to be cleaned, dried and ironed.

The above object and advantages are achieved with a machine for cleaning stains, washing, drying and ironing according to claim 1. Other characterising aspects of the same machine become evident in the remaining claims depending on the first claim.

BRIEF DESCRIPTION OF THE DRAWINGS

The invention will be illustrated in greater detail in the continuation of the description made in reference to the enclosed indicative and not limitative drawing, in which.

DETAILED DESCRIPTION OF THE INVENTION

In the example shown, the machine according to the invention comprises a body or frame 11 defining a treatment chamber 12 having, at least at the front, an access entrance.

This opening can be hermetically closed by at least one door which can also be transparent to make the interior of the machine visible and to be able to locate the dirtier parts which possibly need to be removed and to follow each washing cycle.

At the base of the body or frame 11 at least one compartment 13 is provided to house, although not shown, the equipment necessary to make the machine operate.

This equipment comprises at least a tank connected to a fresh water feed plant and to a discharge for the dirty washing water; a basin for the detergent; a water heating system; a pump to circulate the water; a hot air generator and control instrumentation.

Figure 1:
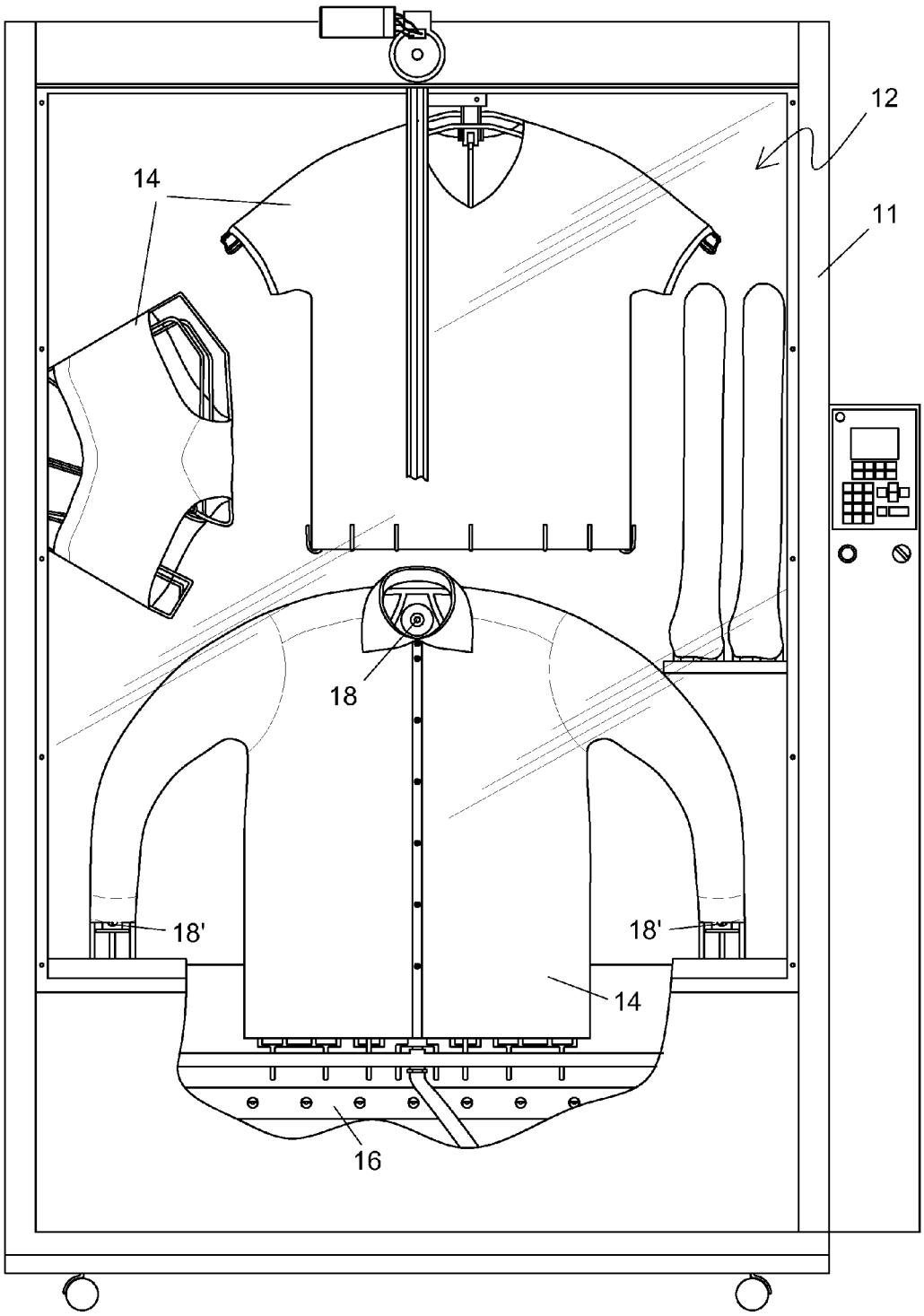
FIG. 1 shows an example of a machine in a schematic form according to the invention without clothing to be washed.
Figure 2:
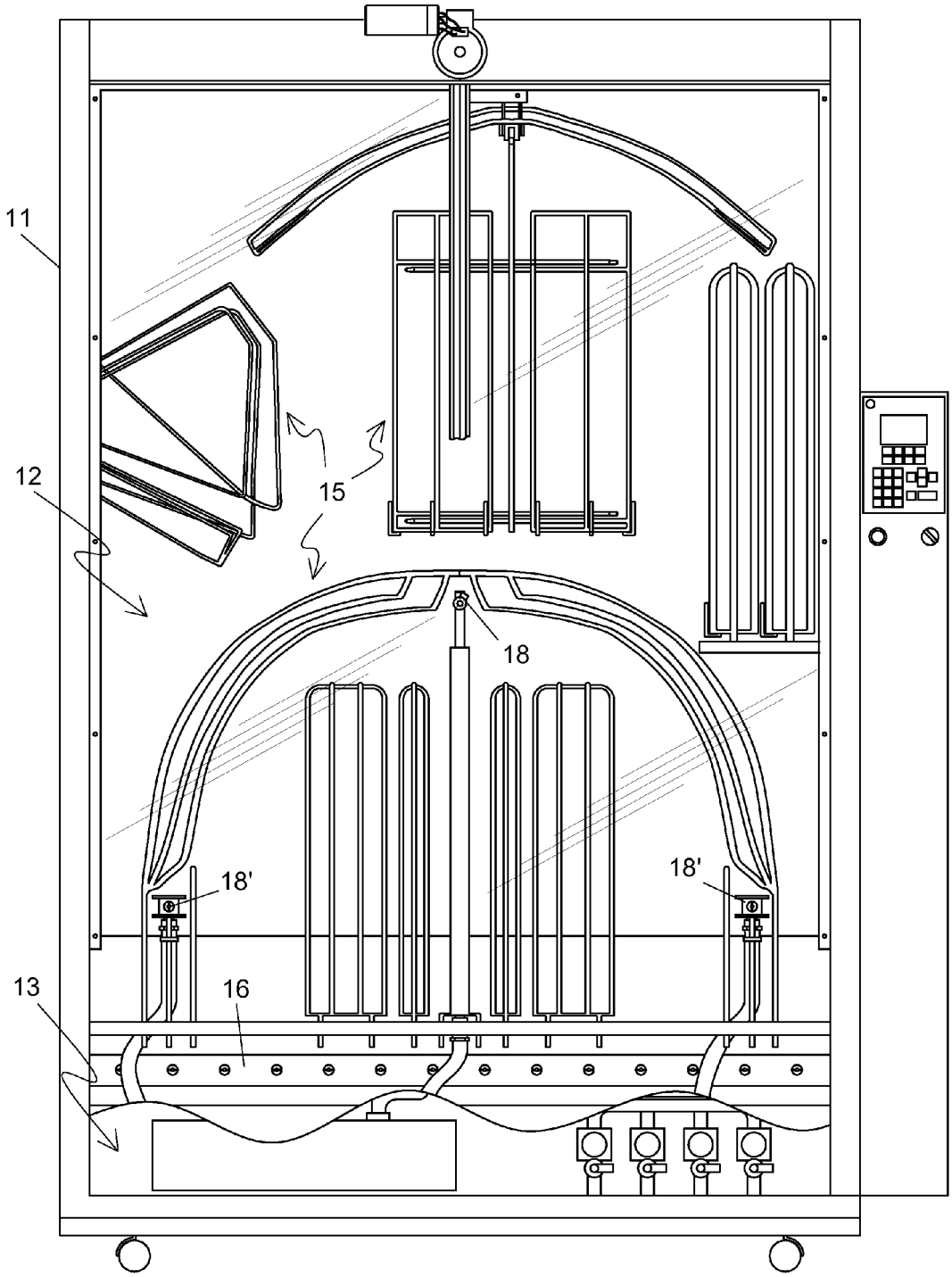
FIG. 2 shows a front view complete with clothing to be washed.
Figure 3:
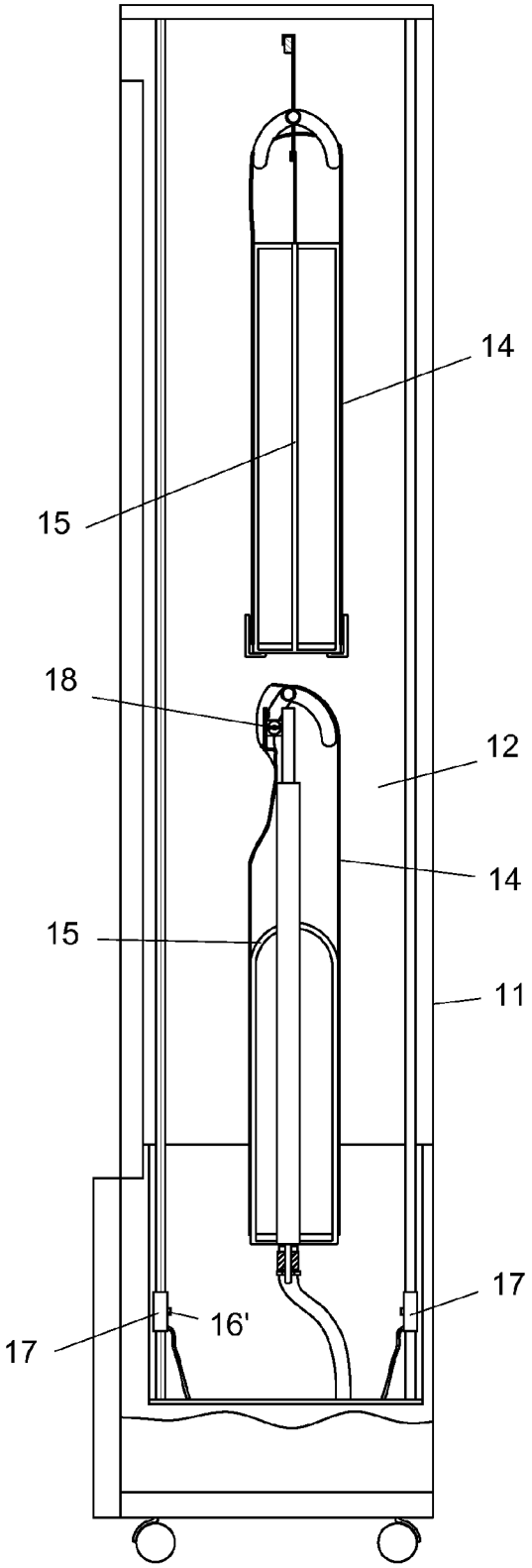
FIG. 3 shows a vertical cross section.
Figure 4:
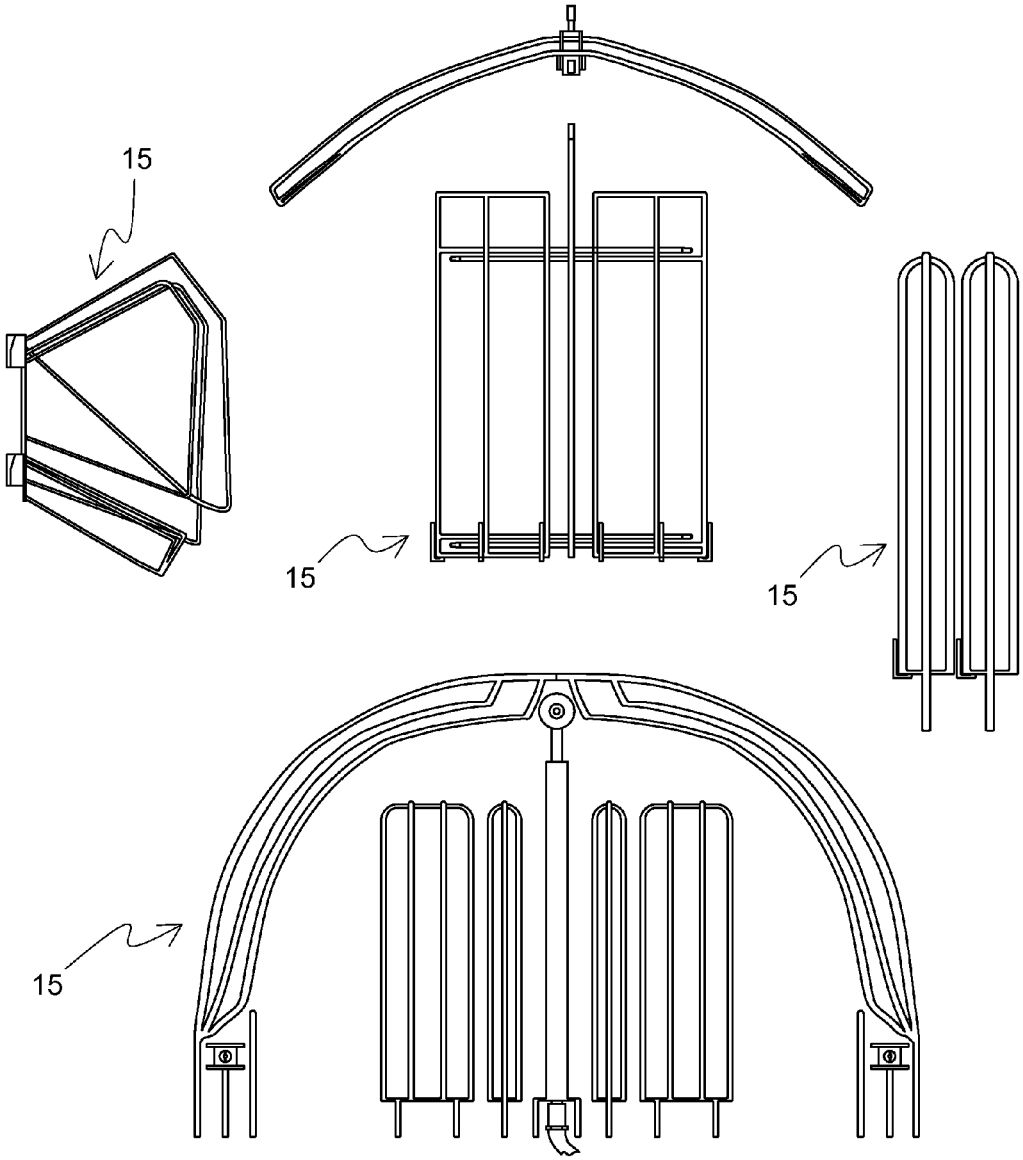
FIG. 4 shows some examples of some hangers or shapes to hold the different items to be treated inside the machine.

In the treatment chamber 12 formed by the body or frame 11 are envisaged means for hanging the garments 14 to treated, for example hangers or shapes 15. Preferably, and as shown in FIG. 4, the hangers or shapes 15 can be dismantled and are also configured to be able to vary their dimensions, so that they are easy to fit inside the garment, suitable to support different sized clothes and principally, able to hold the garment hanging and taut with its front separated and held away from its rear—FIG. 3—to facilitate both washing and successive drying. Inside the body or frame, a sprayer bar 17 is provided with a number of nozzles 16' positioned to produce jets of water, both for washing and rinsing, facing towards the items to be washed. The sprayer bar 17 can be horizontal and movable in height according to the items 14 placed in the machine, for example by means of translation cables. For a more efficient wash two horizontal sprayer bars 17 can be provided with nozzles facing in opposite directions towards the items to be treated. The opposing sprayer bar or bars could also be vertical and movable horizontally with regard to the items to be treated, and as an alternative there could also be at least one horizontal sprayer bar and another vertical sprayer bar on the same side or on opposite sides and both movable depending on the items involved.

In any case the sprayer bars are fed, for example, with water by means of flexible pipes, and the water nozzles can have variable and adjustable pressure depending on the fabric to be washed. Furthermore, all or at least some of the nozzles on each sprayer bar can also be the rotating type to further increase the efficiency of the washing process. In addition, nozzles for spraying water upwards from the bottom towards the top and inside the items can also be provided, together with means, if required, for moving the items with regard to the water jets.

What is more, in one or more sprayer bars the nozzles can be positioned in groups and fed with washing fluid so as to be able to use the nozzles of each group selectively and specifically, independently from the nozzles of every other group.

In addition and to its advantage, the treatment chamber 12 can be further provided with one or more rotating sprayer nozzles 18, 18' on a level with and aimed at the dirtier areas, in particular the collar and/or cuffs, of a garment to be washed. These nozzles will be, for example, the type to deliver a fan-shaped fluid spray, and their rotation can be brought about by the flow of the fluid delivered.

The machine described above can be programmed and run electronically to carry out the normal cleaning, washing and rinsing operations with the addition of a suitable cleaning product, water with detergent and clean water.

As regards to the washing phase, programming of the machine can also be conceived so that the water sprayers remain aimed, they pause and are active for a longer period on those areas which are considered to be the dirtiest of the items to be washed.

This specific treatment aspect can be exploited also to carry out directly in the machine the cleaning of certain parts of garments with the localized, manual or automatic addition of suitable solvents. In addition, each specific cleaning and washing treatment can be programmed so that it can be carried out both manually and automatically, by selecting the position, the number and the pressure of the water sprayers operating from time to time and an appropriate movement of the bar or bars of the sprayer nozzles.

In addition, the treatment chamber of the machine can be virtually divided and mapped out into several zones, and the water sprayers can from time to time be limited in number and directed only in one or some specific zones in the chamber and excluding others.

This is done so as to specify the area occupied by each garment and to be able in this way to wash a single item positioned in any one of the zones of the treatment chamber without any unnecessary waste of water and detergent, rinsing water and energy.

Following the washing and rinsing operations, preceded by possible localized cleaning, the items are dried in the same machine with the help of hot air coming from the relative generator and possibly with the aid of an electric heater positioned in the treatment chamber. The air for drying may be delivered and distributed in the treatment chamber by means of appropriate ducts which may be either fixed or mobile or independent or associated with the sprayer bars. In this respect, at least a part of the rinsing water can be collected in the tank of the machine and the air for drying can be made to flow over said water to favour the condensation of the humidity it is carrying.

The ironing of the items takes place at the same time as they are dried, favoured by the fact that they are hanging, already taut and in shape during the washing process so that they do not crease and the same currents of air during drying tend to spread the materials, already spread however by the water, removing any remaining creases.

The machine described above can be set up and provided with means for carrying out on termination of the cleaning, washing, drying and ironing operations, the sterilization of the garments either by infrared radiation or by the help of a sterilization fluid or jets of steam, the latter being provided by appropriate nozzles—not shown—or by means of the same nozzles of the sprayer bars.

Finally, the machine described above can be set up in modular form so that it can be placed alongside one or more other modules, perhaps inside a mutual frame, so as to be able to set up machines from time to time with different capacities.

The invention claimed is:

1. A multifunction machine for laundries, comprising:

a body or frame defining a treatment chamber hermetically closed and equipped with hangers or shapes for hanging elements, such as bed linen, clothes and garments, to be treated;

sprayer bars provided with nozzles positioned to produce jets of a fluid for a wash and rinse, said sprayer bars being guided vertically and each of said sprayer bars being vertically movable independently from another one of said sprayer bars, wherein vertical movement of said sprayer bars is stopped in correspondence of dirty areas of the hanging elements such that said sprayer bars provide a focused washing of the hanging elements;

one or more of a generator of hot air and an electric heater for drying and ironing said elements while said elements are hanging in said treatment chamber, wherein said hangers or shapes are of different sizes to support different sized clothes and to hold each of said hanging elements, so that each of said hanging elements is stretched, and each of said hangers or shapes has a front portion separated from a back portion such that a front portion and a back portion of said hanging elements are separated from one another.

2. A machine for laundries according to claim 1, wherein said fluid is water and in the body or frame at least one compartment is provided housing equipment for involvement, distribution and discharge of the washing water, for loading and distribution of a detergent, for heating the water, plus a hot air generator to dry and iron the clothes and a control instrument, wherein said hangers or shapes are in a fixed position during washing and rinsing of said hanging elements such that said hangers and shapes do not move relative to said nozzles.

3. A machine for laundries according to claim 2, wherein said treatment chamber is provided with at least one spray bar with nozzles to spray water towards the clothes to be treated, one spray bar at least being either horizontal or vertical and movable according to the clothes hanging and stretched in said treatment chamber.

4. A machine for laundries according to claim 3, further comprising at least one rotating spray nozzle on a level with specific parts, in particular neck and/or cuffs, of an item to be washed.

5. A machine for laundries according to claim 3, wherein, the treatment chamber is provided with two horizontal sprayer bars to produce jets of water in opposite directions, said bars being movable in height in relation to the items hanging in said treatment chamber.

6. A machine for laundries according to claim 5, wherein, the treatment chamber is provided with at least one vertical sprayer bar which is guided and movable horizontally in relation to the items hanging in said treatment chamber.

7. A machine for laundries according to claim 3, further comprising a means for rotating at least some of said nozzles and selectively varying the pressure of the water delivered.

8. A machine for laundries according to claim 5, further comprising a means for selectively pointing and stopping at least some water jets in line with some parts of the items to be washed.

9. A machine for laundries according to claim 5, wherein each of said sprayer bars comprises groups of sprayer nozzles to be used selectively or simultaneously.

10. A machine for laundries according to claim 3, further comprising at least one nozzle for manual or automatic spraying of specific parts of the item to be treated with stain remover fluid.

11. A machine for laundries according to claim 5, further comprising means for programming various operating cycles by choice of a number of sprayer movements and washing water pressure and drying and ironing times in the treatment chamber.

12. A machine for laundries according to claim 1, further comprising means for involvement of a fluid for dry cleaning and means for collecting and re-use of the fluid.

13. A machine for laundries according to claim 1, wherein said body or frame is closed at least by a front transparent door, at least one of said hangers extending in a direction parallel to said front transparent door, wherein the nozzles associated with at least one of said sprayer bars face in a direction of said front transparent door and the nozzles of at least another one of said sprayer bars face in a direction away from said front transparent door.

14. A machine for laundries according to claim 4, wherein, the treatment chamber is provided with two horizontal sprayer bars to produce jets of water in opposite directions, said bars being movable in height in relation to the items hanging in said treatment chamber.

15. A machine for laundries according to claim 1, wherein, the treatment chamber is provided with at least one vertical sprayer bar which is guided and movable horizontally in relation to the items hanging in said treatment chamber.

16. A multifunction machine for laundries, comprising:

a body defining a treatment chamber;

a plurality of hangers, each of said hangers having a hanger front portion and a hanger back portion, said hanger front portion being located at a spaced location from said hanger back portion to define a predetermined stretched hanging element orientation means for receiving a hanging element and for maintaining a front hanging element portion of the hanging element at a spaced location from a back hanging element portion of the hanging element;

a plurality of sprayer bars, each of said sprayer bars comprising nozzles, said nozzles producing jets of fluid for washing and rinsing said hanging elements;

a means for independently moving said sprayer bars in a vertical direction and for stopping said sprayer bars in at least one dirty area of items to be washed to provide a focused washing of the items, whereby each of said sprayer bars is vertically movable independent of movement of another one of said sprayer bars;

a drying and ironing means for drying and ironing hanging elements, wherein each of said hangers comprises a hanger size, said hanger size of each of said hangers being different from said hanger size of another one of said hangers to support different sized hanging elements.

17. A machine for laundries according to claim 16, further comprising:

a plurality of said hanging elements, said hanging elements comprising at least one of bed linen, clothes and garments, each of said hanging elements having a front hanging element portion and a back hanging element portion, said hangers being arranged in said treatment chamber, each of said hanging elements being connected to one of said hangers such that each of said hanging elements is stretched via one of said hangers, wherein said front hanging element portion of one of said hanging elements is separated from said back hanging element portion of said one of said hanging elements via said one of said hangers, wherein each of said hangers comprises a frame structure, said frame structure comprising a plurality of frame portions, at least one of said frame portions being located at a spaced location from another one of said frame portions, at least one of said frame portions being located between said front hanging element portion and said back hanging element portion, said chamber being hermetically closed, said hangers being in a fixed position during washing and rinsing of said hanging elements such that said hangers do not move relative to said nozzles; and a door structure, at least one of said hangers extending parallel to said door structure, said plurality of sprayer bars extending in a direction parallel to said door structure, one of said sprayer bars being movable along a vertical path of movement, wherein at least portion of said vertical path of movement is adjacent to said door structure.

18. A multifunction machine for laundries, comprising:

a body defining a treatment chamber;

a first means for receiving a first hanging element and for providing the first hanging element with a first predetermined stretched hanging element orientation such that a first hanging element front portion of the first hanging element is located at a spaced location from a first hanging element back portion of the first hanging element;

a second means for receiving a second hanging element and for providing the second hanging element with a second predetermined stretched hanging element orientation such that a second hanging element front portion of the second hanging element is located at a spaced location from a second hanging element back portion of the second hanging element;

a plurality of sprayer bars, each of said sprayer bars comprising nozzles, said nozzles producing jets of fluid for washing and rinsing one or more hanging elements, each of said sprayer bars being movable independent of movement of another one of said sprayer bars, wherein each of said sprayer bars is independently movable in a vertical direction;

a drying and ironing means for drying and ironing said one or more hanging elements.

19. A machine for laundries according to claim 18, further comprising:

a means for selectively pointing and stopping one or more of said nozzles such that said one or more nozzles are aligned with an area of one or more of said first hanging element and said second hanging element to provide a focused washing of at least one of said the first hanging element and the second hanging element, wherein said first means comprises a first hanger arranged in said treatment chamber, said first hanger having a first hanger front portion and a first hanger back portion, said first hanger front portion being located at a spaced location from said first hanger back portion, said second hanger comprising a second hanger arranged in said treatment chamber, said second hanger having a second hanger front portion and a second hanger back portion, said second hanger front portion being located at a spaced location from said second hanger back portion, said one or more hanging elements comprising said first hanging element and said second hanging element, said first hanging element comprising a first hanging element front portion and a first hanging element back portion, said first hanging element being connected to said first hanger such that said first hanging element is stretched via said first hanger to define said first predetermined stretched hanging element orientation, wherein said first hanging element front portion is maintained at a spaced location from said first hanging element back portion via said first hanger, at least a portion of said first hanger being arranged between said first hanging element front portion and said first hanging element back portion, said second hanging element comprising a second hanging element front portion and a second hanging element back portion, said second hanging element being connected to said second hanger such that said second hanging element is stretched via said second hanger to define said second predetermined stretched hanging element orientation, wherein said second hanging element front portion is maintained at a spaced location from said second hanging element back portion via said second hanger, at least a portion of said second hanger being arranged between said second hanging element front portion and said second hanging element back portion, wherein each of said first hanger and said second hanger comprises a frame structure, said frame structure comprising a plurality of frame portions, at least one of said frame portions being located at a spaced location from another one of said frame portions, said first hanger comprising a first hanger size, said second hanger comprising a second hanger size, said first hanger size being different from said second hanger size, said first hanging element comprising a first hanging element size, said second hanging element comprising a second hanging element size, said first hanging element size being different from said second hanging element size, said first hanging element and said second hanging element comprising at least one of bed linen, clothes and garments, said chamber being hermetically closed, said first hanger and said second hanger being in a fixed position during washing and rinsing of said first hanging element and said second hanging element such that said first hanger and said second hanger do not move relative to said nozzles.

20. A machine for laundries according to claim 18, further comprising:

a door structure connected to said body, at least one of said first hanging element and said second hanging element being parallel to said door structure, said plurality of sprayer bars extending parallel to said door structure.

* * * * *